US005632652A

United States Patent [19]

Zell et al.

[11] Patent Number: 5,632,652

[45] Date of Patent: May 27, 1997

[54] PLUG-TYPE CONNECTOR FOR BACKPLANE WIRINGS

[75] Inventors: Karl Zell, Niederpoecking; Juergen Seibold, Baierbrunn; Peter Seidel, Groebenzell, all of Germany

[73] Assignee: Siemens Aktiengesellschaft, Munich, Germany

[21] Appl. No.: 431,569

[22] Filed: Apr. 11, 1995

[30] Foreign Application Priority Data

Apr. 14, 1994 [DE] Germany ..... 44 12 950.5

[51] Int. Cl.[6] ..... H01R 9/05

[52] U.S. Cl. ..... 439/581; 439/607; 439/723

[58] Field of Search ..... 439/98, 716, 723, 439/725, 581, 607

[56] References Cited

U.S. PATENT DOCUMENTS 4,628,652 12/1986 Wefels .
4,895,522 1/1990 Grabbe et al. ..... 439/581 X
4,988,312 1/1991 Suzuki et al. ..... 439/581
5,160,272 11/1992 Zell et al. ..... 439/607 X
5,273,457 12/1993 Zell et al. ..... 439/581
5,344,341 9/1994 Yoshino ..... 439/607
5,516,307 5/1996 Cartesse et al. ..... 439/581

FOREIGN PATENT DOCUMENTS 0103192 6/1986 European Pat. Off. .

*Primary Examiner*—Jes F. Pascua
*Attorney, Agent, or Firm*—Hill, Steadman & Simpson

[57] ABSTRACT

The invention is directed to plug-type connectors for backplane wirings composed of blade connector and spring clip, whereby the individual contact springs are surrounded by electrically conductive shieldings that are connected to contactings applied in the intermediate grid both at the backplane side as well as at the assembly side, said contactings being charged with an appropriate potential.

The invention discloses various possibilities for contacting between the shielding in the spring clip and the printed circuit boards carrying the shield potential.

2 Claims, 5 Drawing Sheets

PLUG-TYPE CONNECTOR FOR BACKPLANE WIRINGS

BACKGROUND OF THE INVENTION

The present invention is generally directed to a plug-type connector for backplane wirings. More particularly, the present invention relates to such a connector having a blade connector fashioned as a rectangular housing open at one side for plugging onto the blades of a wiring backplane and with a spring clip pluggable into the blade connector in a mated fashion. The spring clip is provided with receptacle chambers and is firmly joined to an assembly printed circuit board, whereby the blades and springs are arranged parallel in a plurality of rows. The individual contact springs are surrounded by electrically conductive shieldings that are connected to contactings applied in the intermediate grid both at the backplane side as well as at the assembly side, the contactings being charged with an appropriate potential.

Such a plug-type connector for backplane wirings is disclosed, for example, by European patent application 94 103 192.4. Over and above this, plug-type connectors have been proposed wherein the shielding ensues with different all-metal housings or, respectively, sheet metal housings. The shield contacting is thereby to be resolved in the tightest space at the plug side.

SUMMARY OF THE INVENTION

It is, therefore, an object of the present invention to provide a shield contacting for connecting the shielding to a corresponding potential on the printed circuit board and which assures a reliable contact in the tightest space.

This object is achieved by a plug-type connector according to the present invention wherein the shield contactings are composed of wire contact pins, known as bunch plugs, pressed into the printed circuit board, the contact pins contacting the shield material of the spring clip in corresponding recesses. A reliable contact is assured in that this bunch plug comprises a plurality of resilient wires.

In an embodiment, the shield contactings include helical pins pressed into the printed circuit board which contact the shielding material of the spring clip in corresponding recesses.

A reliable contact is realized by the helical form and a good lateral tolerance compensation is present at the same time.

Additional features and advantages of the present invention are described in, and will be apparent from, the detailed description of the presently preferred embodiments and from the drawings.

BRIEF DESCRIPTION OF THE DRAWINGS

FIG. 1 is a side view of one of the bunch-plug type contact pins. FIG. 2 is a front sectional view of a connector taken generally along line II—II of FIG. 3. FIG. 3 is a side sectional view taken generally along line III—III of FIG. 2.

FIG. 4 is a side sectional view. FIG. 5 is a front sectional view, an upper portion taken generally along line B—B of FIG. 4, a lower portion taken generally along line A—A of FIG. 4.

FIG. 6 is a side sectional view. FIG. 7 is a sectional view taken in part generally along plane VII of FIG. 6.

FIG. 9 is a sectional side view taken generally along line IX—IX of FIG. 10. FIG. 10 is a sectional front view.

DETAILED DESCRIPTION OF THE PRESENTLY PREFERRED EMBODIMENTS

Figure 1:
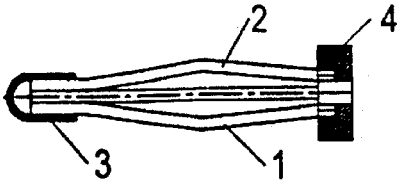
FIGS. 1–3 illustrate a shielded connector embodiment with a bunch-plug type contact.
Figure 2:
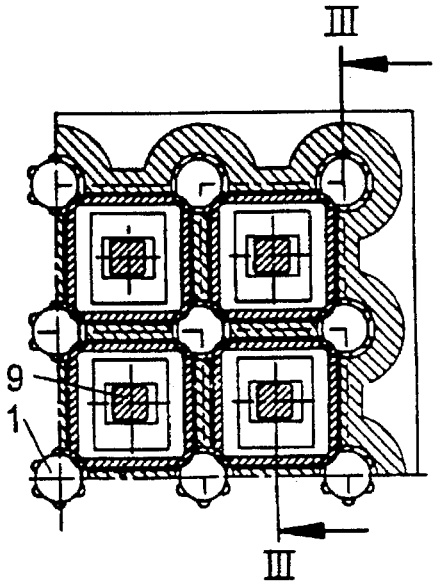
Figure 3:
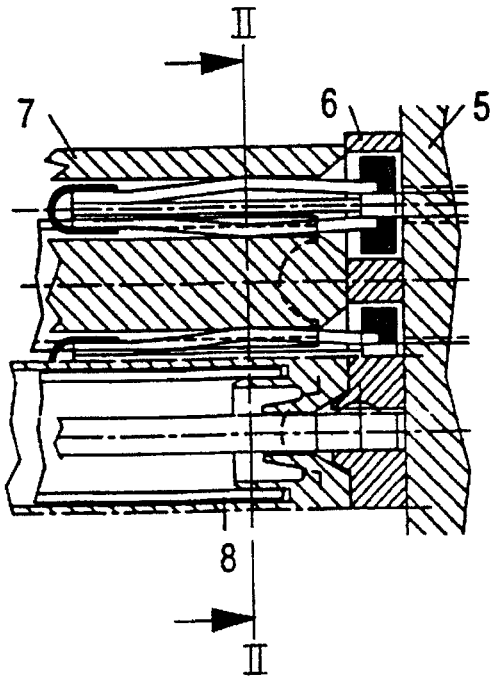

FIGS. 1–3 show a shield contacted with wire contact pins 1 of a type known as bunch plugs that are pressed into a wiring backplane 5 (FIG. 3). These contact pins 1 are constructed in a traditional way of a plurality of individual wires 2 having a cap 3 and additionally have a position-limiting press-in shoulder 4 in order to press them into the wiring backplane 5. In the illustrated exemplary embodiment, the contact pins 1 each contact within a respective receptacle tube 8 into which the contact springs are introduced for this purpose in insulated fashion. The receptacle tubes 8 are accommodated in the spring clip housing 7. The contact pins 1, as well as the contact blades 9, engage through a floor 6 of the blade connector into the spring clip 7. All-metallic housing embodiments can be contacted with this shield contacting. Given a plurality of wires 2, housings made of galvanic plastic, individual tube up through all-metal can be contacted. Sheet metal compartments can be well-contacted given four wires and correctly oriented press-in placement.

Figure 4:
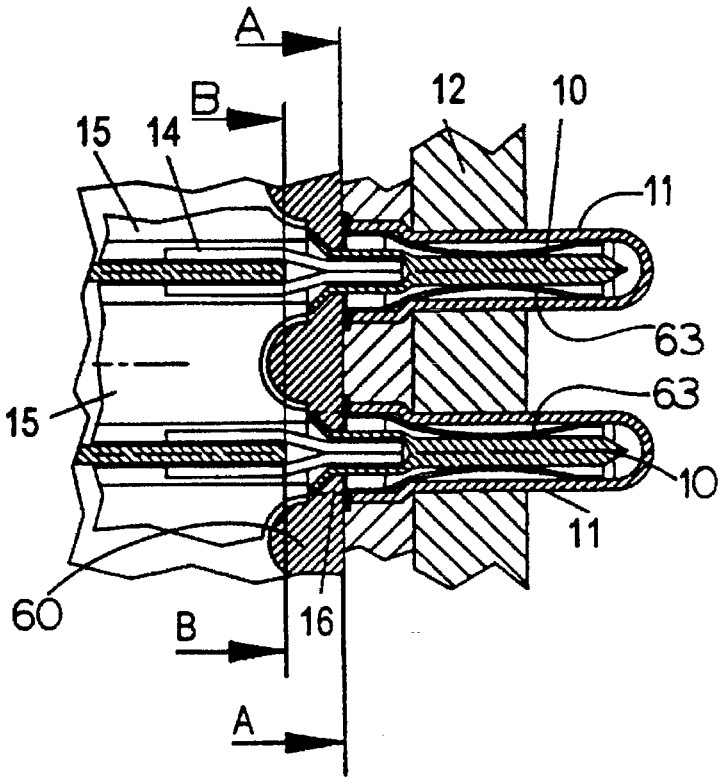
FIGS. 4 and 5 illustrate another shielded connector embodiment.
Figure 5:
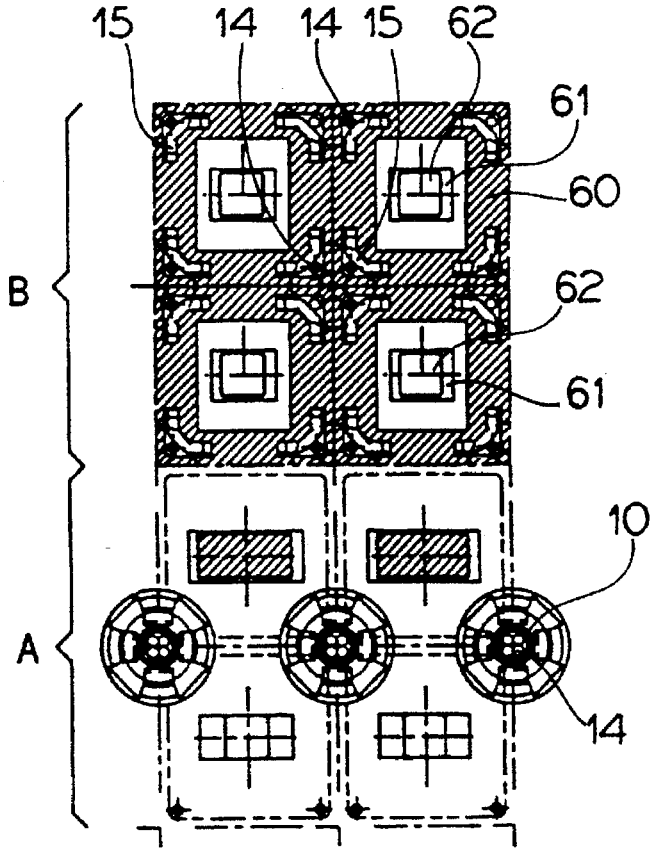

FIGS. 4 and 5 show an embodiment of a plug-type connector having a housing 60 with which defines a plurality of receptacle chambers for containing plurality of signal-carrying contact springs 61. The housing is open at one side, adapted for pluggable connection onto standard blades 62 of a wiring backplane 12. The blades 62 are contactably received in a known manner by respective contact springs 61 when the connector is plugged onto the backplane 12.

A plurality of tubular shields 15 are provided within the housing 60 in an arrangement wherein each tubular shield 15 generally surrounds one of the contact springs 61. In the illustrated embodiment, the tubular shields 15 are generally square in cross-section. The connector includes a plurality of contact pins 10 which are secured to the housing 60, protruding outwardly toward the backplane 12.

The shields 15 are conductively connected to each other and to the contact pins 10 by a plurality of wires 14 secured respectively to the contact pins by soldering or welding. The wires 14 are preferably connected to the respective contact pin 10 in a quad-form, such as illustrated in the center of FIG. 5B, with one of the wires 14 being connected to a corner of each adjacent tubular shield 15. In assembly, the wires 14 bunch upon insertion of each tube 15 into the plastic housing 60, and the wires 14 are bunched together in an axial recess of the contact pin 10. Prior to this bunching insertion, in an embodiment, the contact pins are secured in the housing with a means such as ultrasonic welding.

A plurality of tubular bushings 11 are secured into the wiring backplane 12, for example, by means of a press-fit. The tubular bushings 11 have an open end facing the connector, and an opposite end which may be either open or closed. Interiorly, each of the bushings 11 includes inner inwardly-directed springs 63 adapted to receive respective contact pins 10. A reflux of the shield current into a neighboring chamber, which could result in noise emissions, is minimized by advancing the contact location into the wiring backplane 12. More specifically, as shown in FIG. 4, the point of contact of the contact pins 10 to the springs 63 preferably lies within a thickness dimension of the backplane 12.

The tubular shields 15 are supplied with a shield potential, the shields 15 being conductively connected through the wires 14, contact pins 10, and inner springs 63 to the tubular bushings 11, in the manner described above and as shown in FIGS. 4 and 5. These connected conductive elements form a contacting through which the shield potential is delivered. This contacting, in the manner mentioned at the outset on page 1, is provided at the backplane side of the connector, as shown, and in an embodiment, at the opposite, printed circuit board side of the connector.

Figure 6:
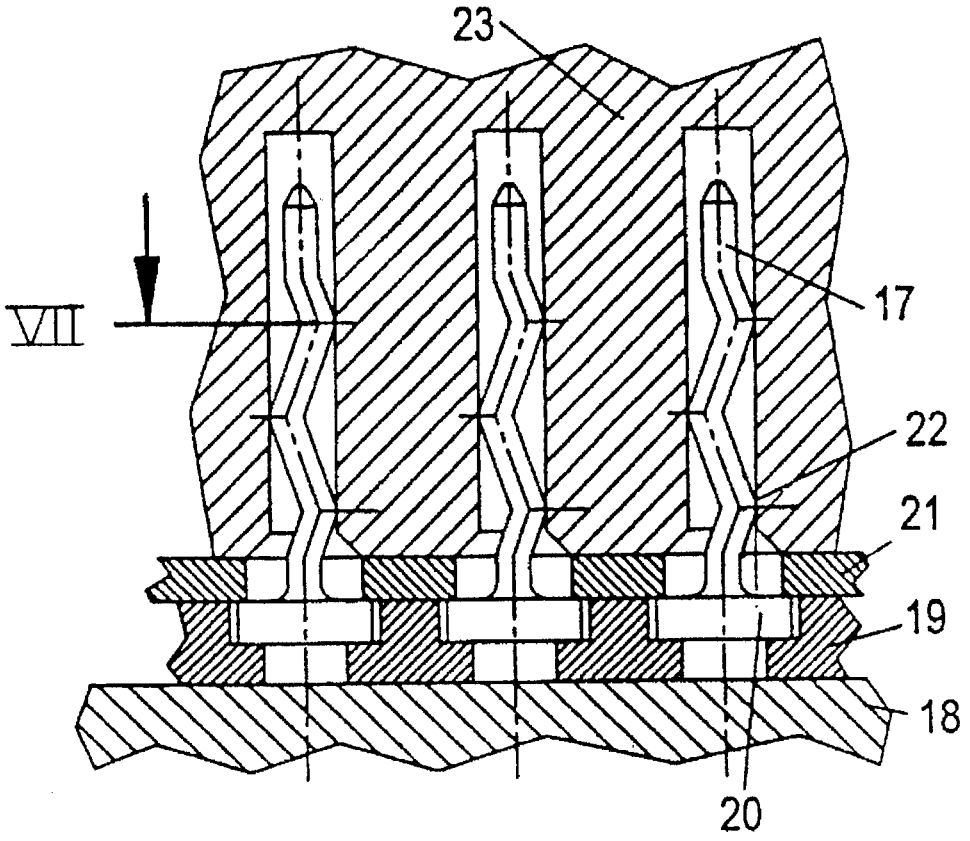
FIGS. 6 and 7 illustrate a shielded connector embodiment having helical contact pins.
Figure 7:
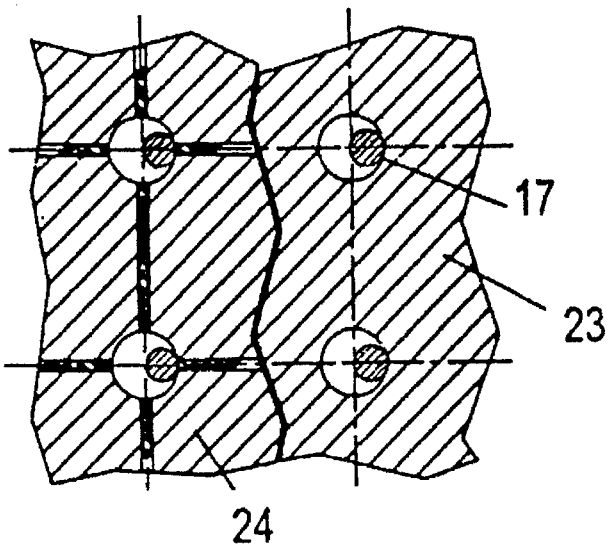

FIGS. 6 and 7 show a contacting with a helical pin 17 that is pressed into a wiring backplane 18 and engages into the spring clip through a floor 19 of a blade connector and through a plastic covering 21. A press-in shoulder 20 is provided on the pin 17 for seating the pin 17 as it is pressed into the wiring backplane 18.

Both sheet metal compartments, indicated by the one section through a spring clip housing 24 in FIG. 7, as well as all-metal housings, indicated by a spring clip housing 23 in FIG. 7, can be contacted with this pin form, whereby a good, lateral tolerance compensation is present due to the helical contact location. Given a sheet metal compartment, the sheet metal is slightly salient into the bore of the plastic housing. It is absolutely necessary to define at least one turn for central and uniform contacting. In that a helical geometry is present, the shield dissipation is contacted at the ideal location in the proximity of the outside surface of the housing.

Figure 8:
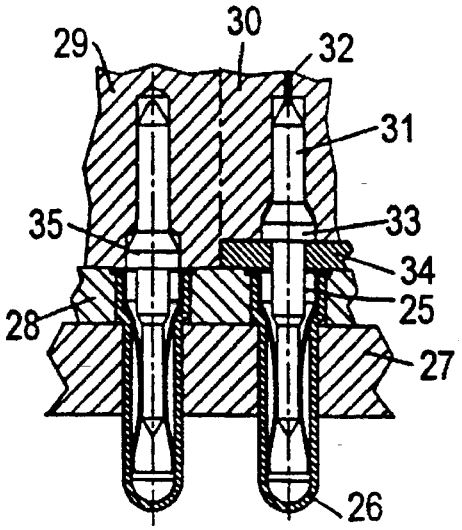
FIG. 8 illustrates a shielded connector embodiment having pressed-in contact pins.

FIG. 8 shows the shield contacting with contact pins 25 pressed into the spring clip housing. For example, the spring clip housing can be an all-metal spring clip housing 29 or a plastic spring clip housing 30 having a sheet metal compartment. The contact pins 25 have their respective press-in zone 31 firmly anchored in the spring clip housing and have contacting zones 33 and 35. In the plugged condition, the contact pins 25 engage into bushings 26 with contact springs that are pressed into the wiring backplane 27. The bushings terminate flushly with the floor of the blade connector 28. Given a sheet metal compartment, the back region of the pin is pressed into the plastic housing, whereas the front region is contacted to the sheet metal. As a result thereof, the shield dissipation is placed into the region of the plug face.

Figure 9:
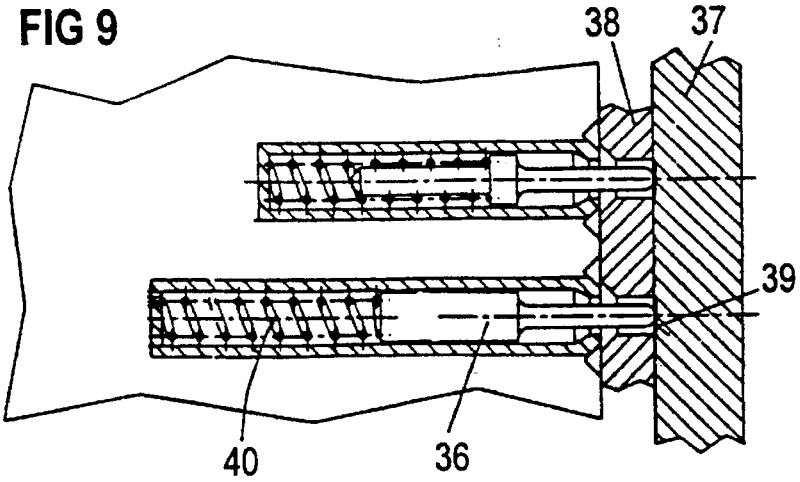
FIGS. 9–10 illustrate a shielded connector with spring-borne contact springs.
Figure 10:
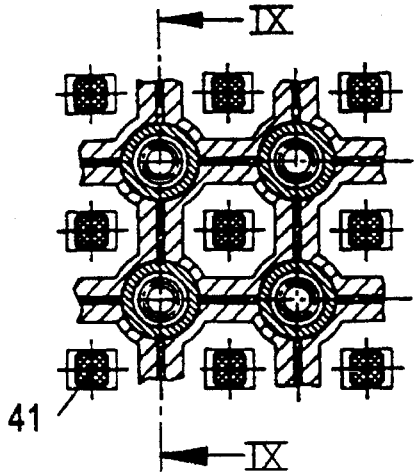

FIGS. 9 and 10 show shield contactings with spring-borne contact pins 36. Given this type of shield contacting, it is possible to eliminate a need for a through-contacted hole for a corresponding contact blade or, respectively, to forgo a bushing. The contact pin 36 spring-borne with the spring 40 is gold-plated at the rounded or pointed tip and encounters a gold-plated contact surface 39 on the wiring backplane 37 after passing through the floor 38 of the blade connector. Noise emission as a result of projecting press-in zones of contact elements is not possible as a result thereof. FIG. 10 shows an active signal contact 41. The springs 40 and the contact pins 36 can be individually pressed in or can be pressed in as a sub-assembly with cage, being pressed into the sheet metal compartment or, respectively, into an all-metal housing.

Figure 11:
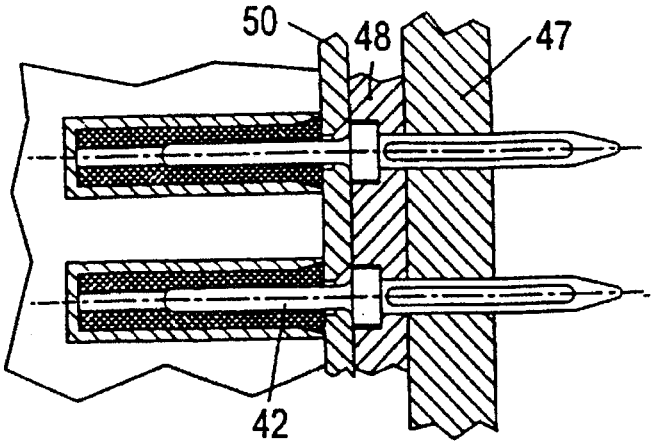
FIG. 11 illustrates an embodiment having contact pins with wire weave cushions.
Figure 12:
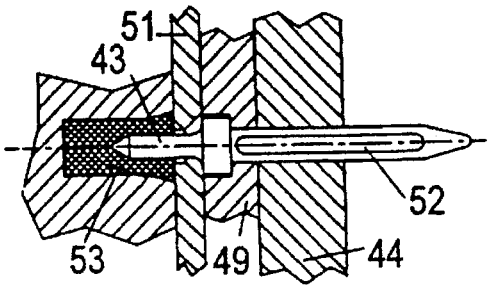
FIG. 12 illustrates an embodiment having a short contact pin with a wire weave cushion.
Figure 13:
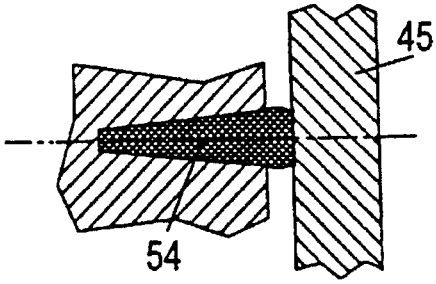
FIGS. 13 and 14 illustrate embodiments with wire weave cushions contactable against a backplane.
Figure 14:
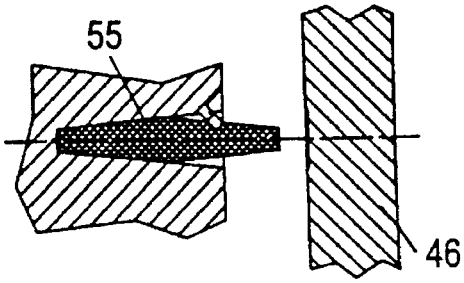

FIGS. 11–14 show a shield contacting with a conductive wire mesh cushion such as a wire weave or a contact wool. The cushion or wire weave 53–55 can thereby be plugged into a bore, whereby this cushion 53–55 is individually inserted or is inserted into the sheet metal compartment or, respectively, into the all-metal housing as a sub-assembly with cage as well. The contact pins 42 and 43 are each respectively pressed into the wiring backplane 44–47 and engaged through the blade connector floor 48 or, respectively, 49 and the plastic covering 50, 51 into the region with the wire weave or, respectively, the contact wool. FIG. 11 shows a wire weave cushion with an inside hole and long contact pin, as a result whereof larger assembly dimensional interlock tolerances can be achieved. FIG. 12 shows a wire weave cushion without an inside hole and with a short contact pin, whereby the resiliency of the cushion is exploited. FIG. 13 shows a wire weave cushion that projects beyond the plug face and contacts on an interconnect lug of the wiring backplane 45 upon utilization of the resiliency of the cushion. A noise emission due to projecting press-in zones of contact elements is thereby not possible.

It should be understood that various changes and modifications to the presently preferred embodiments will be apparent to those skilled in the art. Such changes and modifications may be made without departing from the spirit and scope of the present invention and without diminishing its attendant advantages. Therefore, such changes and modifications are intended to be covered by the appended claims.

What is claimed is:

1. A plug-type connector comprising:

a backplane having a plurality of blades;

a housing open at one side adapted for plugging onto blades of a wiring backplane;

a plurality of contact springs mounted within said housing, each contact spring being adapted to contactably receive one of said blades of the wiring backplane;

a plurality of electrically conductive tubular shields disposed within said housing such that each of said tubular shields generally surrounds one of said contact springs; and a plurality of contact pins, the contact pins being secured to the housing and protruding therefrom, each of said contact pins having at least one wire connected thereto within the housing, each wire contacting one of the tubular shields, the contact pins and wires being arranged between the tubular shields such that adjacent tubular shields are interconnected by one of said contact pins and respective wires;

a plurality of tubular bushings disposed in the backplane in a press-fit manner, each bushing having inner inwardly directed springs which, in a plugged condition, receive a respective one of the contact pins, such that a shielding potential applied to the tubular bushings is delivered to the tubular shields through the respective inwardly directed springs, contact pins, and wires.

2. A plug-type connector as defined by claim 1, wherein each of the contact pins includes a recess, and wherein there are four respective wires connected to each of the contact pins, the four respective wires being bunched together into the recess, each of the four wires contacting a different respective one of the tubular shields.

* * * * *